United States Patent [19]

Matsui et al.

[11] 4,420,534

[45] Dec. 13, 1983

[54] CONDUCTIVE COMPOSITE FILAMENTS AND METHODS FOR PRODUCING SAID COMPOSITE FILAMENTS

[75] Inventors: Masao Matsui, Takatsuki; Hiroshi Naito; Kazuo Okamoto, both of Osaka, all of Japan

[73] Assignees: Kanebo Synthetic Fibers Ltd., Osaka; Kanebo, Ltd., Tokyo, both of Japan

[21] Appl. No.: 268,026

[22] Filed: May 28, 1981

[30] Foreign Application Priority Data

| | | | |
|---|---|---|---|
| Jun. 6, 1980 | [JP] | Japan | 55-76901 |
| Jun. 14, 1980 | [JP] | Japan | 55-80753 |
| Jun. 19, 1980 | [JP] | Japan | 55-83650 |

[51] Int. Cl.[3] ..... D02G 3/00

[52] U.S. Cl. ..... 428/372; 428/373; 428/374; 428/379; 428/397

[58] Field of Search ..... 428/372, 373, 374, 375, 428/379, 384, 397; 264/171

[56] References Cited

U.S. PATENT DOCUMENTS

| | | | |
|---|---|---|---|
| 3,639,556 | 2/1972 | Matsui et al. | 264/171 |
| 3,803,453 | 4/1974 | Hall | 428/375 X |
| 3,958,066 | 5/1976 | Imamura et al. | 428/373 X |
| 4,010,308 | 3/1977 | Wiczer | 428/372 |
| 4,185,137 | 1/1980 | Kinkel | 428/373 X |
| 4,216,264 | 8/1980 | Naruse et al. | 428/397 |
| 4,242,382 | 12/1980 | Ellis et al. | 428/372 X |
| 4,309,479 | 1/1982 | Naruse et al. | 428/397 |

FOREIGN PATENT DOCUMENTS

| | | | |
|---|---|---|---|
| 797730 | 10/1968 | Canada | 428/397 |
| 55-137221 | 10/1980 | Japan | 264/171 |

*Primary Examiner*—Lorraine T. Kendell

*Attorney, Agent, or Firm*—Flynn, Thiel, Boutell & Tanis

[57] ABSTRACT

Conductive composite filaments are disclosed that are formed by conjugate-spinning a conductive component composed of a thermoplastic polymer and/or a solvent soluble polymer and conductive metal oxide particles and a non-conductive component composed of a fiber-forming polymer.

31 Claims, 18 Drawing Figures

CONDUCTIVE COMPOSITE FILAMENTS AND METHODS FOR PRODUCING SAID COMPOSITE FILAMENTS

The present invention relates to conductive composite filaments and methods for producing said composite filaments.

Composite filaments, in which a conductive layer composed of a polymer containing conductive particles, for example, metal particles, carbon black, etc., is bonded to a protective layer (non-conductive layer) composed of a fiber-forming polymer, have been well known and used for providing an antistatic property by mixing these composite filaments with other fibers. However, the filaments containing carbon black are colored black or gray, the appearance of produced articles is deteriorated and the uses thereof are limited.

Concerning metal particles, it is very difficult to produce metal particles having a grain size of less than 1 μm, particularly less than 0.5 μm, and ultra fine particles are very expensive and very poor in practicality. Furthermore, metal particles having a small grain size are, for example, melted and bonded (sintered) with one another by high temperature and high pressure upon melt-spinning and are separated as coarse particles or a metal mass, and it is very difficult to melt-conjugate-spin the mixture.

An object of the present invention is to provide conductive composite filaments which are not substantially colored and have excellent conductivity and antistatic property.

Another object of the present invention is to provide methods for commercially easily producing these filaments.

The present invention relates to conductive composite filaments wherein a conductive component composed of a thermoplastic polymer and/or a solvent soluble polymer and conductive metal oxide particles, and a non-conductive component composed of a fiber-forming polymer are bonded.

The conductive composite filaments of the present invention are ones wherein a conductive component containing conductive metal oxide particles and a non-conductive component are bonded and the non-conductive component protects the conductive component and can give a satisfactory strength to the filaments.

The polymers to be used for the conductive component are binders of conductive metal oxide particles and are not particularly limited. The thermoplastic polymers include, for example, polyamides, such as nylon-6, nylon-11, nylon-12, nylon-66, nylon-610, nylon-612, etc., polyesters, such as polyethylene terephthalate, polybutylene terephthalate, polyethylene oxybenzoate, etc., polyolefins, such as polyethylene, polypropylene, etc., polyethers, such as polymethylene oxide, polyethylene oxide, polybutylene oxide, etc., vinyl polymers, such as polyvinyl chloride, polyvinylidene chloride, polystyrene, etc., polycarbonates, and copolymers and mixtures consisting mainly of these polymers. The solvent soluble polymers include acrylic polymers containing at least 85% by weight of acrylonitrile, modacrylic polymers containing 35–85% by weight of acrylonitrile, cellulose polymers, such as cellulose, cellulose acetate, vinyl alcohol polymers, such as polyvinyl alcohol and saponified products thereof, and polyurethane, polyurea, and copolymers or mixtures consisting mainly of these polymers. As these polymers, polymers having low fiber-forming ability also may be used but polymers having fiber-forming ability are preferable.

In view of the conductivity, among these polymers, ones having crystallinity of not less than 40%, particularly not less than 50%, more preferably not less than 60% are preferable. The above described polyamides, polyesters and acrylic polymers have crystallinity of about 40–50% and as the polymers having crystallinity of not less than 60%, mention may be made of polyolefins, such as crystalline polyethylene, crystalline polypropylene, polyethers, such as polymethylene oxide, polyethylene oxide, etc., linear polyesters, such as polyethylene adipate, polyethylene sebacate, polycaprolactone, polycarbonates, polyvinyl alcohols, cellulose and the like.

As the fiber-forming polymers applicable to the present invention, use may be made of polymers capable of being melt spun, dry spun and wet spun, for example, among the above described thermoplastic polymers and solvent soluble polymers, fiber-forming polymers may be used. Among the fiber-forming polymers, polyamides, polyesters and acrylic polymers are preferable. To the fiber-forming polymers may be added various additives, such as delusterants, pigments, coloring agents, stabilizers, antistatic agents (polyalkylene oxides, various surfactants).

The conductive metal oxide particles in the present invention are fine particles having conductivity based on the conductive metal oxides contained therein, and are concretely particles consisting mainly (not less than 50% by weight) of a conductive metal oxide and particles coated with a conductive metal oxide.

Most metal oxides are insulators or semi-conductors and do not show enough conductivity to satisfy the object of the present invention. However, the conductivity is increased, for example, by adding a small amount (not more than 50%, particularly not more than 25%) of a proper secondary component (impurity) to the metal oxide, whereby conductive metal oxide powders having sufficient conductivity to satisfy the object of the present invention can be obtained. For example, a small amount of powdery oxide, hydroxide or inorganic acid salt of aluminum, gallium, indium, germanium, tin and the like is added to powdery zinc oxide (ZnO) and the resulting mixture is fired under a reducing atmosphere or the like to prepare conductive zinc oxide powder. Similarly, conductive tin oxide powder can be obtained by adding a small amount of antimony oxide to tin oxide ($SnO_2$) powder and firing the resulting mixture. Even a secondary component other than the above described substances, if it can provide conductive particles which can increase the conductivity, does not considerably deteriorate whiteness, and is stable to water, heat, light and chemical agents generally used for fibers, such component can be used for the object of the present invention.

As the conductive metal oxides, the above described zinc oxide or tin oxide is excellent in the conductivity, whiteness and stability but even other metal oxides, if these oxides have the satisfactory conductivity, whiteness and stability, can be used for the object of the present invention. As such substances, mention may be made of, for example, indium oxide, tungsten oxide, zirconium oxide and the like.

As the particles coated with conductive metal oxide, mention may be made of particles wherein the above described conductive metal oxide is formed on metal oxide particles, such as titanium oxide ($TiO_2$), zinc oxide (ZnO), iron oxide ($Fe_2O_3$, $Fe_3O_4$, etc.), aluminum oxide ($Al_2O_3$), magnesium oxide (MgO), etc. or inorganic compound particles, such as silicon oxide ($SiO_2$), etc. Similarly, a film of conductive silver oxide, copper oxide or copper suboxide shows an excellent conductivity but copper oxide has a defect that the coloration is high (the coloration can be improved by making the film thin).

The conductivity of the conductive metal oxide particles is preferred to be not more than $10^4$ Ω·cm (order), particularly not more than $10^2$ Ω·cm, most preferably not more than $10^1$ Ω·cm in the specific resistance in the powdery state. In fact, the particles having $10^2$ Ω·cm–$10^{-2}$ Ω·cm are obtaned and can be suitably applied to the object of the present invention. (The particles having the more excellent conductivity are more preferable.) The specific resistance (volume resistivity) is measured by charging 5 gr of a sample into a cylinder of an insulator having a diameter of 1 cm and applying 200 kg of pressure to the cylinder from the upper portion by means of a piston and applying a direct current voltage (for example, 0.001–1,000 V, current of less than 1 mA).

The conductive metal oxide particles are preferred to be ones having high whiteness, that is the reflectivity in powder form being not less than 40%, preferably not less than 50%, more particularly not less than 60%. The above described conductive zinc oxide particles can provide reflectivity of not less than 60%, particularly not less than 80%, and conductive tin oxide can provide reflectivity of not less than 50%, particularly not less than 60%. Titanium oxide particles coated with conductive zinc oxide or conductive tin oxide film can provide reflectivity of 60–90%. The reflectivity of carbon black particles is about 10% and the reflectivity of metallic iron fine particles (average grain size 0.05 μm) is about 20%.

The conductive metal oxide particles must be small in the grain size. Particles having an average grain size of 1–2 μm can be used but in general, an average grain size of not more than 1 μm, particularly not more than 0.5 μm, more preferably not more than 0.3 μm, is used. As the grain size becomes smaller, when a binder polymer is mixed therewith, a higher conductivity is shown in a lower mixed ratio.

The conductive layer must have satisfactory conductivity. In general, the conductive layer must have a resistance of not more than $10^7$ Ω·cm, particularly not more than $10^6$ Ω·cm, and a specific resistance of not more than $10^4$ Ω·cm is preferable and not more than $10^2$ Ω·cm is most preferable.

For better understanding of the invention, reference is made to the accompanying drawings, wherein.

Figure 1:
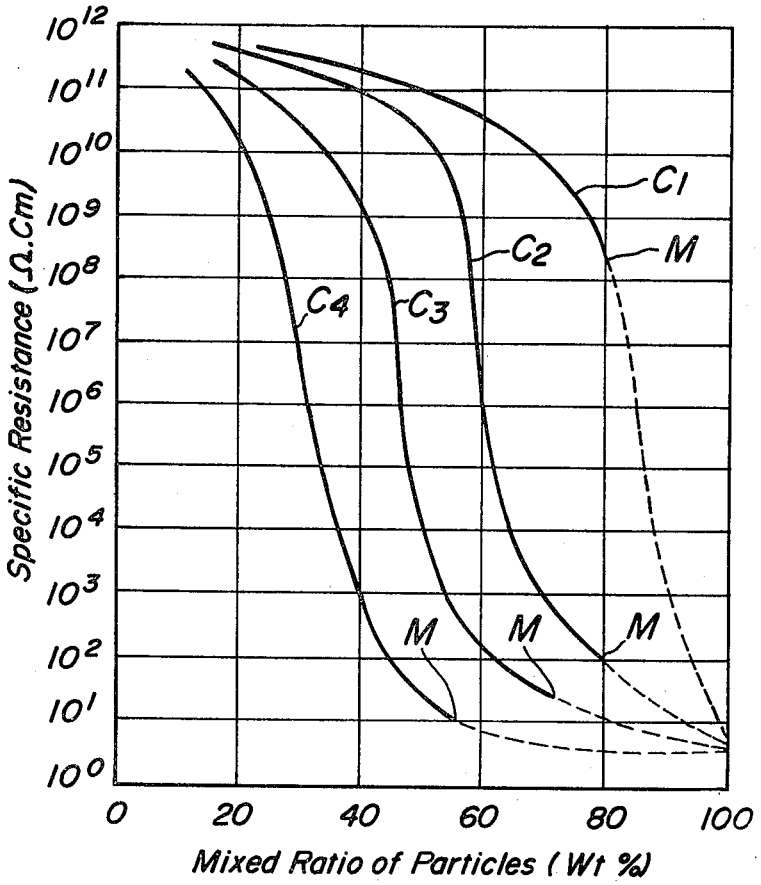
FIG. 1 is a graph showing the relation of the specific resistance to the mixed ratio of the conductive metal oxide particles and a polymer (binder)

FIG. 1 shows the relation of the specific resistance to the mixed ratio of the conductive metal oxide particles and the polymer (binder). The curve $C_1$ is an embodiment of a mixture of conductive particles having a grain size of 0.25 μm and a non-crystalline polymer (polypropylene oxide). As seen from the curve $C_1$, when the non-crystalline polymer is used, the mixed ratio of the conductive particles should be less than 80% because in such a case, the mixture loses fluidity and spinning becomes very difficult or infeasible. In FIG. 1, the solid line shows the zone where the mixture can be flowed by heating and the broken line shows the zone where the flowing is difficult even by heating. That is, the point M is the upper limit of the mixed ratio where the mixture can be flowed by heating and at mixed ratios higher than the limit, a low viscosity substance, that is, a fluidity improving agent, such as a solvent, a plasticizer or the like must be used (added).

The curve $C_2$ is an embodiment of a mixture of conductive particles having a grain size of 0.25 μm and a highly crystalline polymer (polyethylene) and this mixture shows the satisfactory conductivity at the mixed ratio of not less than 60%.

The curve $C_4$ is an embodiment showing the relation of the mixed ratio of conductive particles having a grain size of 0.01 μm and a high crystalline polymer (polyethylene) to the specific resistance. When the grain size is very small, as shown in FIG. 1, the excellent conductivity is shown by the low mixed ratio (30–55%). The reason why the particles having a small grain size show the high conductivity is presumably based on the fact that the particles readily form a chain structure. On the other hand, the particles having a small grain size very easily agglomerate and dispersion (uniform mixing) of such particles into the polymer is very difficult and the obtained mixture often contains masses wherein particles agglomerate and the fluidity and spinnability are poor.

The curve $C_3$ is an embodiment of a mixture of particles having a grain size of 0.25 μm and particles having a grain size of 0.01 μm in a ratio of 1/1, and a highly crystalline polymer (polyethylene). The positions of the curve $C_3$ between the curve $C_2$ and the curve $C_4$ shows an average behavior for the particles. In this mixed particle system, the conductivity and the fluidity are fairly improved but there remains problems with respect to the difficulty of uniform dispersion and the spinnability.

The behavior of particles having a grain size of 0.05–0.12 μm is similar to that of the above described mixed system of particles of 0.25 μm and particles of 0.01 μm, is between both these larger and smaller particles, and the conductivity is excellent, but uniform dispersion is difficult and the spinnability is poor.

Finally, particles having a grain size of about 0.25 μm, that is 0.13–0.45 μm, particularly 0.15–0.35 μm are most commercially useful in view of the relative ease of dispersing same in the polymer, the excellent uniformity, fluidity and spinnability of the obtained mixture and the handling ease.

The term "grain size" used herein means the weight average diameter of a single particle. A sample is observed by an electron microscope and is separated into single particles. Diameters (mean values of the long diameter and the short diameter) of about 1,000 particles are measured and classified by a unit of 0.01 μm to determine the grain size distribution and then the weight average grain size is determined from the following formulae (I) and (II).

$$\text{Grain average weight } \overline{W} = \frac{\sum_{i=1}^{n} NiWi^2}{\sum_{i=1}^{n} NiWi} \quad \text{(I)}$$

wherein

Ni: Number of particles classified in No. i.

Wi: Weight of particles classified in No. i.

$$\text{Grain weight } W = \frac{\pi}{6} \rho D^3. \quad \text{(II)}$$

wherein $\rho$: Density of particle.

D: Diameter of particle.

The mixed ratio of the conductive metal oxide particles in the conductive component is varied depending upon the conductivity, purity, structure, grain size, chain forming ability of particle, and the property, kind and crystallinity of the polymer but is generally within a range of 30–85% (by weight), preferably 40–80%. When the mixed ratio exceeds 80%, the fluidity is deficient and a fluidity improving agent (low viscosity substance) is needed.

In addition to the conductive metal oxide particles, other conductive particles may be used together with the metal oxide particles in order to improve the dispersability, conductivity and spinnability of the particles. For example, copper, silver, nickel, iron, aluminum and other metal particles may be mixed. In the case of use of these particles, the mixed ratio of the conductive metal oxide particles may be smaller than the above described range but the main component (not less than 50%) of the conductive particles is the conductive metal oxide particles.

To the conductive component may be added a dispersant (for example, wax, polyalkylene oxides, various surfactants, organic electrolytes, etc.), a coloring agent, a pigment, a stabilizer (antioxidant, a ultraviolet ray absorbing agent, etc.), a fluidity improving agent (a low viscosity substance) and other additives.

The conjugate-spinning (bonding) of the conductive component and the non-conductive component may be carried out in any manner.

FIGS. 2–17 are cross-sectional views showing preferred embodiments of the composite filaments according to the present invention. In these figures, a numeral 1 is a non-conductive component and a numeral 2 is a conductive component.

Figure 2:
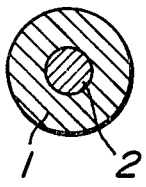
FIGS. 2–17 show the cross-sectional views of the conductive composite filaments of the present invention.
Figure 3:
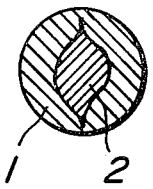
Figure 4:
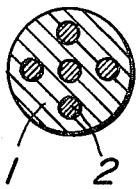
Figure 5:
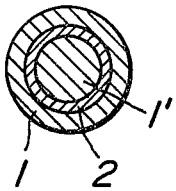
Figure 6:
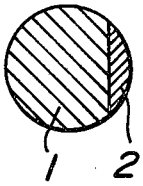

FIGS. 2–5 are embodiments of the sheath-core type composite filaments. FIG. 2 is a concentric type, FIG. 3 is a non-circular core type, FIG. 4 is a multi-core type and FIG. 5 is a multi-layer core type. In FIG. 5, a core 1' is surrounded by another core 2. The layers 1 and 1' may be the same polymer or different polymers.

Figure 7:
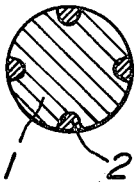
Figure 8:
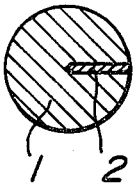
Figure 9:
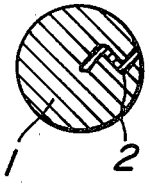
Figure 10:
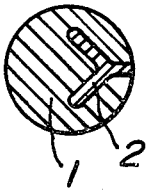
Figure 11:
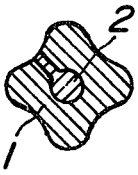
Figure 12:
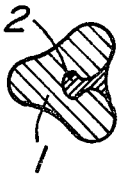

FIGS. 6–12 are side-by-side type embodiments. FIG. 7 is a multi-side-by-side type, FIG. 8 is an embodiment wherein a conductive component is inserted in a linear form, FIG. 9 is an embodiment wherein a conductive component is inserted in a zigzag form, FIG. 10 is an embodiment wherein a conductive component is inserted in a branched form, FIG. 11 is an embodiment wherein a conductive component is conjugate-spun in a keyhole form and FIG. 12 is an embodiment wherein a conductive component is conjugate-spun in a flower vase form.

Figure 13:
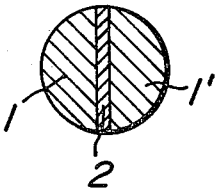
Figure 14:
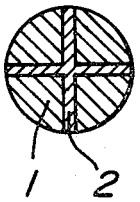
Figure 15:
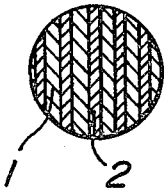
Figure 16:
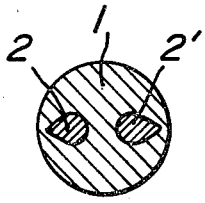
Figure 17:
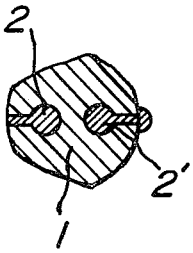

FIG. 13 is an embodiment of a three layer composite, FIG. 14 is an embodiment wherein a conductive component is conjugate-spun in a radial form and FIG. 15 is an embodiment of a multi-layer composite. FIG. 16 is an embodiment wherein non-circular multi-core conductive components are eccentrically arranged and FIG. 17 is an embodiment wherein a conductive component is exposed to the filament surface by subjecting the filament shown in FIG. 16 to false twisting, and in this case, the conductive components 2 and 2' may be different.

In general, in the sheath-core type composite filaments wherein the conductive component is the core, the effect for protecting the conductive component by the non-conductive component is high but since the conductive component is not exposed to the surface, there is a defect that the antistatic property is somewhat poor.

On the other hand, in the side-by-side type, the conductive component is exposed to the surface, so that the antistatic property is excellent but the effect of protecting the conductive component with the non-conductive component is poor. However, in the embodiments as shown in FIGS. 8–15 wherein the conductive component is inserted in thin layer form or is mostly surrounded by the non-conductive component (for example, not less than 70%, particularly not less than 80%), the protective effect and the antistatic property are excellent and these embodiments are preferable.

The area ratio, that is the conjugate ratio occupied by the conductive component in the cross-section of the composite filaments is not particularly limited, if the object of the present invention can be attained, but is preferred to be generally 1–80%, particularly 3–60%.

Concrete explanation will be made with respect to the conductive composite filaments according to the present invention.

As the polymers having a crystallinity of not less than 60%, which are suitable for the conductive component, mention may be made of highly crystalline polyolefins, polyethers, polyesters, polycarbonates, polyvinyl alcohols, celluloses and the like.

In these highly crystalline polymers there are some polymers which are inferior in practical use because of water solubility and low melting point, but these polymers are useful in produced articles which are used at low temperature or are not exposed to water.

However, polyamides, polyesters and polyacrylonitriles, which are suitable for the polymers of the non-conductive component, are poor in the affinity to the highly crystalline polymers suitable for the above described conductive component and the mutual bonding property upon conjugate-spinning is poor, so that disengagement is apt to be caused by drawing and the like. For preventing the disengagement of the components, carrying out conjugate-spinning so that the conductive component is a core and the protective component is a sheath has been considered, but in general, conductive composite filaments wherein the conductive component is not exposed to the filament surface are somewhat poor in the antistatic property and improvement is desired.

FIGS. 8–12 show the examples of composite filaments wherein the antistatic property and the disengagement of both the components are improved and the conductive component 2 is exposed to the surface (the conductive component 2 occupies a part of the surface area of the filament). Furthermore, the conductive component has a substantially even width or has an increasing width towards the inner portion of the protective component, so that the conductive component 2 and the non-conductive component 1 are hardly disengaged and even if disengagement occurs between both the components, these components are not substantially separated.

The shape of cross-section of the conductive component 2 may be linear as shown in FIG. 8, zigzag as shown in FIG. 9 and other curved or branched forms as shown in FIG. 10. Furthermore, the composite filaments wherein the conductive components are of increased width towards the inner portion as shown in FIGS. 11 and 12 are preferable. In FIG. 12, the conductive component is expanded toward the inner portion from the neck portion and the disengagement of both the components is satisfactorily prevented.

The resistance against the disengagement or separation of both the components increases in proportion to the bonding area. It is desirable that the conductive component is deeply inserted to a certain degree. For example, in FIGS. 8–12, the length of the inserted component is about ½ of the diameter of the filament. This inserted length is preferred to be 1/5–4/5, particularly ¼–¾ of the diameter (in the non-circular filaments, the diameter of a circle having an equal area).

In the composite filaments wherein the disengagement is improved, the conjugate ratio (occupying ratio in cross-section) of the conductive component is optional but is preferred to be generally 1–40%, particularly 2–20%, more particularly 3–10%. The conjugate ratio in the embodiment of FIG. 8 is about 2.5%.

The degree of exposure, that is, the ratio of the surface area occupied by the conductive component in the composite filaments wherein the disengagement is improved, is not more than 30%. Even if this occupying ratio is small, the antistatic property is not substantially varied and the disengagement is broadly improved. In general, this occupying ratio is preferably not more than 20%, particularly not more than 10%, more preferably 1–7%. In the embodiments in FIGS. 8–11, the occupying ratio is about 2–5%.

The composite structures shown in FIGS. 8–12 wherein the disengagement is improved, are suitable for the combination of a plurality of components having poor mutual stickiness but also suitable even for the combination of components having excellent mutual stickiness.

The conductive component using the conductive metal oxides contains a fairly large amount of conductive particles, so that the content of the polymer used as the binder is small and therefore the mechanical strength of the formed composite filaments becomes poor and brittle.

Therefore, there is fear that the conductive component will be broken due to drawing and friction, and that conductivity will be lost, but in the composite filaments as shown in FIGS. 8–12, the conductive component is inserted deeply into the protective component, so that the protective effect is high and the durability of conductivity is high.

In order to improve the durability of the conductivity against external force and heat, it is preferable to increase the mutual affinity of the protective component polymer and the conductive component polymer. For this purpose, to either or both of the polymers is mixed or copolymerized one of the polymers or a third component, whereby the affinity or adhesion can be improved.

Explanation will be made hereinafter with respect to methods for producing the conductive composite filaments of the present invention.

The conductive composite filaments of the present invention can be produced by a usual melt, wet or dry conjugate-spinning. For example, in melt spinning, a first component composed of a fiber-forming polymer and if necessary, an additive, such as antioxidant, fluidity improving agent, dispersant, pigment and the like and a second component (conductive component) composed of conductive metal oxide particles, a binder of a thermoplastic polymer and if necessary, an additive are separately melted and fed while being metered in accordance with the conjugate ratio. The components are then bonded in a spinneret or immediately after spinning through spinning orifices, cooled and wound up, and if necessary drawn and/or heat-treated.

Similarly, in wet spinning, a first component solution containing a solvent-soluble fiber-forming polymer and if necessary an additive and a second component (conductive component) solution dissolving conductive metal oxide particles, a solvent soluble polymer as a binder and if necessary an additive in a solvent are fed while being metered in accordance with the conjugate ratio, bonded in a spinneret, or immediately after spinning through spinning orifices, coagulated in a coagulation bath, wound up, if necessary washed with water, and drawn and/or heat-treated.

In dry spinning, both the component solutions are spun, for example, into a gas in a spinning tube instead of the coagulation bath used in wet spinning, if necessary heated to evaporate and remove the solvent, and wound up, if necessary washed with water, drawn and/or heat-treated.

In the usual production of fibers, when the fibers are subjected to the drawing step and other steps, the molecular orientation and crystallization are advanced and satisfactory strength can be obtained. However, when the composite filaments consisting of the conductive component containing the conductive metal oxide particles and the reinforcing fiber-forming component are drawn, the chain structure of the conductive particles is cut by drawing and in many cases, the conductivity is apt to be lowered and in a severe case, the conductivity is substantially lost (the specific resistance becomes not less than $10^8$ Ω·cm). Accordingly, in order to obtain the composite filaments having excellent conductivity and antistatic property, it is necessary to solve or improve the problem of the decrease of the conductivity owing to drawing. Explanation will be made hereinafter with respect to methods for solving or improving this problem.

The first method is pertinent selection of the grain size of the conductive particles. As seen from FIG. 1, the smaller the grain size, the higher is the conductivity of the mixture of the conductive particles and the polymer of the binder. However, the super fine particles having a diameter of not more than 0.1 μm, particularly not more than 0.5 μm pose a difficult problem of uniform mixing. For solving this problem, it is necessary to improve the selection of the dispersant, the mixer and mixing method. For example, the viscosity of the mixture can be lowered by using a solvent and the resulting mixture is stirred strongly or for a long time and the resulting solution is, directly or after concentration, subjected to wet or dry spinning, or after removing the solvent, the mixture may be melt spun.

In a mixture system of the grain sizes of 0.25 μm and 0.01 μm shown in the curve $C_3$ and the particles having a grain size of about 0.05–0.12 μm, the conductivity and uniform dispersion (mixture) show the intermediate behavior of both the grain sizes (0.25 μm and 0.01 μm) and an improving effect can be observed.

The second method is the pertinent selection of the polymer of the binder. As seen from the comparison of the curve $C_1$ with the curve $C_2$ in FIG. 1, the mixture (curve $C_1$) of the non-crystalline polymer and the conductive particles has substantially no conductivity and the mixture (curve $C_2$) of the highly crystalline polymer and the conductive particles is high in the conductivity.

In general, as the polymer of the binder, the highly crystalline polymers are desired. The crystallinity (by density method) is preferred to be not less than 40%, particularly not less than 50%, more particularly not less than 60%.

The third method is pertinent selection of heat-treatment. The decrease of the conductivity due to drawing is particularly noticeable in cold drawing and can be fairly improved by hot drawing. When the drawing temperature or the temperature of heat-treatment after drawing is near the softening point or melting point of the polymer of the binder or higher than the melting point of the polymer of the binder, the improving effect is often particularly higher than that of usual hot drawing and heat treatment.

In order to practically carry out this method, the non-conductive component, that is the protective layer of the composite filaments, must have a sufficiently higher softening point or melting point than the drawing or heat-treating temperature. That is, the fiber-forming polymers, which are the non-conductive component, are preferred to have a higher softening point or melting point than the thermoplastic polymers or solvent soluble polymers which form the conductive layer.

The fourth method is to produce the final product by using conductive composite filaments having a low orientation, that is undrawn or semi-drawn (half oriented) conductive composite filaments. It is relatively easy to produce undrawn yarns having excellent conductivity by using the composite filaments composed of the conductive component containing the conductive metal oxide particles and the non-conductive component. These undrawn yarns have the tendency that the conductive structure is readily broken by drawing, but the inventors have found that in many cases, up to a certain limit value, that is with not more than 2.5, particularly not more than 2 of draw ratio and not more than 89%, particularly not more than 86% of orientation degree, the conductive structure is not substantially broken.

Figure 18:
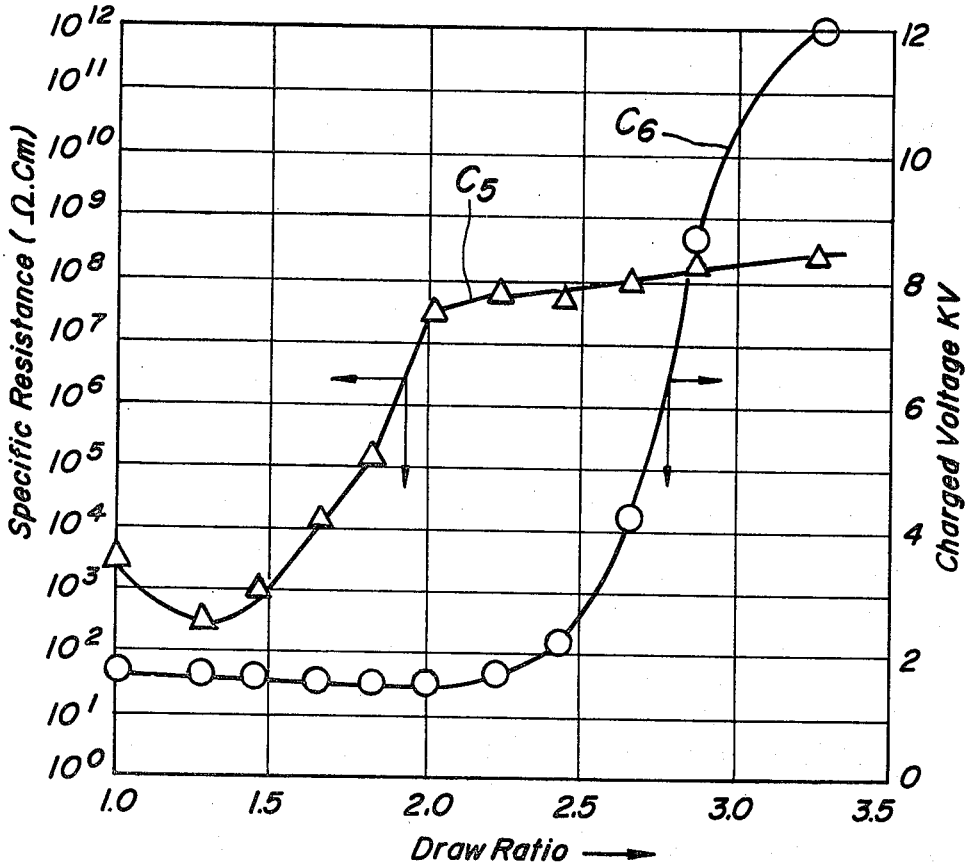
FIG. 18 is a graph showing the relation of the draw ratio to the specific resistance and the charged voltage of the conductive composite filaments.

FIG. 18 shows the relation of the draw ratio to the specific resistance and antistatic property of the composite filaments as shown in FIG. 13 obtained by melt-conjugate-spinning nylon-12 as a non-conductive component and a mixture of 75% of conductive metal oxide particles having a grain size of 0.25 μm, 24.5% of nylon-12 and 0.5% of magnesium stearate (dispersant) as a conductive component at a usual spinning velocity. The antistatic property was evaluated by the charged voltage due to friction of knitted goods wherein the above described composite filaments are mixed (mixed ratio: about 1%) in a knitted good made of nylon-6 drawn yarns in an interval of about 6 mm. As seen from the curve $C_5$ in FIG. 18, as the draw ratio increases, the specific resistance suddenly increases but at the draw ratio of not less than 2.0, the increase becomes gradual. On the other hand, as shown in the curve $C_6$, the charged voltage is substantially constant at the draw ratio of not more than 2.5 but suddenly increases at the draw ratio of more than 2.5 and the antistatic property is lost. Namely, at the specific resistance of not less than $10^8$ Ω·cm, there is no antistatic property and at the specific resistance of not more than $10^7$ Ω·cm, the antistatic property is satisfactorily realized. That is, at the draw ratio of not more than 2.5 (orientation degree: not more than 89%), particularly not more than 2.0 (orientation degree: not more than 86%), satisfactory conductivity and antistatic property are realized and when the draw ratio exceeds 2.5, the antistatic property is lost. This limit zone varies depending upon the properties of the conductive particles and the polymers of the binder but in many cases the draw ratio is 2.0–2.5 and the orientation degree is 70–89%.

Yarns having a low orientation, that is undrawn or semi-drawn yarns of the conductive composite filaments, may be directly used for production of the final fibrous product. But, when the undrawn or semi-drawn yarns are subjected to external force, particularly tension in the production steps of fibrous articles, for example, knitting or weaving steps and the like, there is fear that the conductive composite filaments will be drawn and the conductivity will be lost. Therefore, it is desirable that the conductive composite filaments having a low orientation (orientation degree: not higher than 89%) are doubled, or doubled and twisted with non-conductive fibers having a high orientation and then the resulting yarns are preferably used in the steps for producing knitted or woven fabrics and other fibrous articles.

Explanation will be made with respect to the doubling hereinafter.

Each of the polymers for forming conductive composite filaments having a low orientation and non-conductive fibers having a high orientation (orientation degree, not less than 85%, particularly not less than 90%) may be optionally selected. However, in view of the heat resistance and dye affinity, it is most preferable that these polymers be the same or of the same kind. For example, all the non-conductive component (protective) polymer (1), the conductive component (binder) polymer (2) of the conductive composite filaments and the polymer (3) of the non-conductive fibers having high orientation may be polyamides and this is preferable. Similarly, all the above described three polymers may be polyesters, polyacrylic polymers or polyolefins and these polymers are preferable.

The doubling may be carried out by a known method. It is more preferable to integrate both the components by a proper means so as not to separate both the components. For example, twisting, entangling by means of an air jet and bonding using an adhesive are useful. For the purpose, the twist number is preferred to be not less than 10 T/m, particularly 20–500 T/m. The twist number is preferred to be not less than 10/m, particularly 20–100/m. As the bonding method, mention may be made of treatment of yarns with an aqueous solution, an aqueous dispersion or a solvent solution of polyacrylic acid, polymethacrylic acid, polyvinyl alcohol, polyvinyl acetate, polyalkylene glycol, starch, dextrine, arginic acid or derivatives of these compounds.

The ratio of doubling may be optional. The mixed ratio of the conductive composite filaments in the doubled yarns is preferred to be 1–75% by weight, particularly 3–50% and the fineness of the doubled yarns is preferred to be 10–1,000 deniers, particularly 20–500 deniers for knitted or woven fabrics.

The fifth method is to take up the composite filaments while orienting them moderately or highly upon spinning. In this case, the obtained filaments can be used without effecting the drawing (draw ratio 1) or can be used for production of fibrous articles after drawing in a draw ratio of not more than 2.5. For this purpose, it is necessary to give a satisfactory orientation degree to the composite filaments upon spinning so as to provide the satisfactory strength of more than 2 g/d, particularly more than 3 g/d in a draw ratio of 1–2.5. The orientation degree of the usual melt spun undrawn filaments is not more than about 70%, in many cases not more than about 60% but for attaining the above described object, the orientation degree of the spun filaments (undrawn) is preferred to be not less than 70%, particularly not less than 80%. The filaments having an orientation degree of not less than 90%, particularly not less than 91% are highly oriented filaments and drawing is often not necessary.

The method for increasing the orientation degree of the spun filaments upon spinning comprises applying a higher shear stress while the spun filaments are being deformed (fining) in fluid state prior to solidification. For example, the velocity for taking up the spun filament is increased, the viscosity of the spinning solution is increased or the spinning deformation ratio (fining ratio) is increased. The method for increasing the viscosity of the spinning solution comprises increasing the molecular weight of the polymer, increasing the concentration of the polymer (dry or wet spinning) or lowering the spinning temperature (melt spinning).

The shearing stress applied to the spun fibers can be evaluated by measuring the tension of the filament during spinning. In the case of melt spinning, the tension of the spinning filament in usual spinning is not more than 0.05 g/d, particularly not more than 0.02 g/d, but moderately or highly oriented filaments can be obtained by making the tension to be not less than 0.05 g/d, particularly 0.07–1 g/d.

The sixth method is combination of two or more of the above described first to fifth methods. For example, it is possible to combine the second method with the third method or combine the first method therewith.

Explanation will be made with respect to the methods for producing the conductive composite filaments of the present invention.

Method 1 for producing the conductive composite filaments of the present invention comprises conjugate-spinning a non-conductive component composed of a fiber-forming polymer and a conductive component composed of a thermoplastic polymer having a melting point lower by at least 30° C. than the melting point of the non-conductive component and conductive metal oxide particles and heat treating the spun composite filaments at a temperature which is not lower than the melting point of the above described thermoplastic polymer and is lower than the melting point of the above described fiber-forming polymer, during or after drawing, or during drawing and successively.

Method 2 for producing the conductive composite filaments of the present invention comprises conjugate-spinning a solution of a non-conductive component composed of at least one polymer selected from the group consisting of acrylic polymers, modacrylic polymers, cellulosic polymers, polyvinyl alcohols and polyurethanes in a solvent and a solution of a conductive component composed of a solvent soluble polymer and conductive metal oxide particles in a solvent, drawing the spun filaments and heat treating the drawn filaments.

Method 3 for producing the conductive composite filaments of the present invention comprises melting a non-conductive component composed of a fiber-forming polymer and a conductive component composed of a thermoplastic polymer and conductive metal oxide particles respectively, conjugate-spinning the molten components at a taking up velocity of not less than 1,500 m/min and if necessary, drawing the spun filaments at a draw ratio of not more than 2.5.

In the above described method 1, the heat treatment is effected at a temperature between the melting point of the polymer of the binder in the conductive component and the melting point of the polymer of the non-conductive component. In order to actually carry out the heat treatment and make said treatment effective, it is necessary that the melting points of both the components are satisfactorily different and the difference of the melting points is not less than 30° C. If the difference of the melting points is less than 30° C., it is difficult to select the pertinent heat treating temperature and there is a great possibility that the strength of the non-conductive component will be deteriorated by the heat treatment. Therefore, the difference of the melting points is preferred to be not less than 50° C., most preferably not less than 80° C. For example, as the non-conductive component polymer, use is made of a polymer having a melting point of not lower than 150° C. and as the conductive component polymer (binder), use is made of a polymer having a melting point, which is lower by not less than 30° C. than the melting point of the non-conductive component polymer, for example, a polymer having a melting point of 50°–220° C. Such a non-conductive component polymer and such a conductive component polymer are combined and conjugate spun at a temperature between the melting points of both the polymers, for example, 50°–260° C., particularly 80°–200° C., and then the drawing is effected.

The heat treatment can be carried out after drawing of the composite filaments. That is, the conductive structure broken by the drawing can be again grown by heating and cooling to recover the conductivity. For example, the drawn filaments are heated under tension or relaxation at a temperature which is higher than the melting point or softening point of the conductive component polymer (binder) and is lower than the melting point or softening point of the non-conductive component polymer, and then cooled, whereby the conductive structure can be again grown. In this case, the difference of the melting point or softening point of both the polymers is preferred to be the above described range and it is desirable that the difference is large to a certain degree (not less than 30° C., particularly not less than 50° C.). Since the polymers should not be solidified (crystallized) at a temperature at which the fibers are used, the melting point of the polymers having a low melting point is preferred to be not lower than 40° C., particularly not lower than 80° C., more particularly not lower than 100° C., and the temperature of the heat treatment is preferably 50°–260° C., particularly 80°–240° C. In general, it is frequently difficult to draw undrawn filaments at too high a temperature (not lower than 150° C., particularly not lower than 200° C.), so that the heat treating process after drawing is more broadly used than the above described hot drawing process. In reality, it is most effective to combine the hot drawing and the heat treatment after drawing. Furthermore, it is highly practical that the drawing is carried out at a temperature of about 40°-120° C. and only the heat treatment after drawing is carried out at a temperature between the melting points of the polymers.

The heat treatment after drawing may be carried out under dry heat or wet heat under tension or relaxation. Of course, it is possible to continuously carry out the heat treatment while running the filaments or to carry out batch treatment of yarns would on a bobbin or staples. In addition, the above described recovery of the conductivity can be carried out in the steps for dying or finishing yarns, knitted goods, woven or unwoven fabrics, carpets and the like.

In general, the recovery of the conductivity owing to the heat treatment is often more effective in a shrinking (relaxing) treatment than in a stretching treatment. Of course, the shrinking treatment is apt to decrease the strength of the fibers, so that it is necessary to select proper heat treating conditions while taking this point into consideration.

Method 2 of the present invention comprises dry spinning the spinning solutions by dissolving the conductive component and the non-conductive component respectively in solvents or wet spinning these solutions into a coagulation bath. For example, in the case of acrylic polymer, an organic solvent, such as dimethylformamide, diethylacetamide, dimethylsulfoxide, acetone, etc. or an inorganic solvent, such as aqueous solution of rhodanate, zinc chloride or nitric acid is used. The spun filaments are heat treated after drawing.

Concerning the drawing and the heat treatment after drawing of the composite filaments obtained by the wet spinning or dry spinning, the heat treatment mentioned in the method 1 of the present invention can be similarly applied. Thd drawing temperature is preferred to be not lower than 80° C., particularly 100°-130° C. in wet heat and is preferred to be not lower than 80° C., particularly 100°-200° C. in dry heat. The heat treatment after drawing is substantially the same as the above described drawing temperature. The heat after-treatment can be carried out a plurality of times under tension or relaxation, or under the combination thereof. In view of the conductivity, particularly the recovery of the conductivity deteriorated or lost by the drawing, the shrinking heat treatment is preferable but it is desirable to carry out said treatment taking into account the reduction of the strength.

In wet or dry spinning, the spinning material is dissolved in a solvent and then used.

Even when a large amount of conductive metal oxide particles are mixed in the polymer, the fluidity can be improved by diluting the mixture with a solvent, so that this method may be more advantageous than the melt spinning. However, in order to improve the homogeneity, fluidity and coagulating ability of the spinning solution mixture, a variety of additives and stabilizers may be added. To the spinning solution of the non-conductive component may be added a pigment, a stabilizer and other additives.

Method 3 for producing the conductive composite filaments of the present invention comprises melt spinning at a spinning velocity of not less than 1,500 m/min, particularly not less than 2,000 m/min to obtain moderately or highly oriented filaments. In this method, even in the undrawn state or at the draw ratio of not more than 2.5, particularly not more than 2, conductive composite filaments having satisfactorily practically endurable strength, for example, not less than 2 g/d, particularly not less than 2.5 g/d, more particularly not less than 3 g/d can be obtained.

For attaining this object, the spinning velocity must be not less than 1,500 m/min, preferably 2,000-10,000 m/min. In the range of spinning velocity of 1,500-5,000 m/min, particularly 2,000-5,000 m/min, fibers having a fairly high orientation degree can be obtained and in the draw ratio of 1.1-2.5, particularly 1.2-2, satisfactory fibers can be obtained. With a spinning velocity of 5,000-10,000 m/min, satisfactory strength can be obtained in a draw ratio of not more than 1.5 and the fibers can be used even in the undrawing.

The filaments spun at a high spinning velocity are, if necessary, drawn and/or heat treated. In the drawing, the reduction of the conductivity is generally smaller in the hot drawing than the cold drawing. The temperature of the hot drawing is preferred to be 50°-200° C., particularly 80°-180° C. The heat treatment of the drawn filaments or undrawn filaments is carried out at substantially the same temperature under tension or relaxation, whereby the strength, heat shrinkability and conductivity of the fibers can be improved.

The conductive composite filaments of the present invention have excellent conductivity, antistatic property and whiteness. For example, when white pigment, such as titanium oxide is added to the non-conductive component, filaments having more improved whiteness can be obtained. The composite filaments of the present invention generally have whiteness (light reflection) of not less than 50% and in many cases, whiteness of not less than 60%, particularly 70-90%, substantially near white, can be relatively easily obtained. The whiteness of the conventional conductive fibers using carbon black has been about 20-50% and as compared with these fibers, the conductive composite filaments of the present invention have far superior whiteness and are suitable for production of white or light colored fibrous articles for which the conventional conductive composite filaments have been not suitable.

The conductive composite filaments of the present invention can provide the antistatic property to the fibrous articles by being mixed with other natural fibers or artificial fibers having the electric charging property in continuous filament form, staple form, non-crimped form, crimped form, undrawn form or drawn form. The usual mixed ratio is about 0.1-10% by weight of the composite filaments but of course, the mixed ratio of 10-100% by weight or less than 0.1% by weight is applicable. The mixing may be effected by blending, doubling, doubling and twisting, mix spinning, mix weaving, mix knitting and any other well known process.

The crystallinity of polymers is determined by measuring the crystallinity when the sample polymer is spun, drawn and heat treated under approximately the same conditions as in the production of the conductive composite filaments. There are a variety of methods for measuring the crystallinity but the crystallinity is determined by the density method or X-ray diffraction method herein. In the density method, the crystallinity is calculated by the following equation (III).

$$\frac{1}{\rho} = \frac{x}{\rho c} + \frac{(1-x)}{\rho a} \quad \text{(III)}$$

$\rho$: Density of sample
x: Crystallinity (when x=1, 100%)
$\rho c$: Density of crystal portion
$\rho a$: Density of non-crystal portion.

The density $\rho c$ of the crystal portion and the density $\rho a$ of the non-crystal portion of typical fiber-forming polymers (undrawn) are shown in the following table.

| Polymer | ρc | ρa |
|---|---|---|
| Polyethylene | 1.00 | 0.84 |
| Polypropylene (isotactic) | 0.935 | 0.85 |
| Nylon-6 | 1.230 | 1.084 |
| Nylon-66 | 1.24 | 1.09 |
| Polyethylene terephthalate | 1.455 | 1.335 |

For polymers to which the density method cannot be applied, the crystallinity is determined by the following equation (IV) following the X-ray diffraction method.

$$X = \frac{I_c}{I_c + I_a} \quad \text{(IV)}$$

$I_c$: Intensity of scattering due to crystal portion
$I_a$: Intensity of scattering (Halo) due to non-crystal portion The orientation degree of polymers is determined by X-ray diffraction method and calculated by the following equation (V). Half value width $\theta$ of the dispersed curve lines along the Debye ring of the main dispersed peak of X-ray diffraction of the crystal face parallel to the fiber axis was measured.

$$\text{Orientation degree } OR\ (\%) = \frac{180^\circ - \theta}{180^\circ} \times 100 \quad \text{(V)}$$

A sample wherein the crystallization does not proceed, is stretched about 0–5% and heat treated properly under tension to advance the crystallization and the above described measurement is made.

The whiteness of powders is measured by a reflection (scattering) photometer by means of a light source (for example tungsten lamp) that is white or near white. The photometer is calibrated calculating reflectivity of magnesium oxide powders as 100%. The whiteness of fibers is measured by using fibers uniformly wound around a square metal plate having one side of 5 cm in a thickness of about 1 mm as a sample by means of the above described reflection photometer.

The electric resistance of the fibers is measured in atmosphere of 25° C., 33% RH by using fibers in which oils are removed by thoroughly washing, as a sample. 10 Single filaments having a length of 10 cm are bundled, both ends of the bundle are bonded to metal terminals with a conductive adhesive, 1,000 V of direct current is applied between both the terminals, the electric resistance is measured and electric resistance per 1 cm of one single filament is determined. The specific resistance of the conductive component is calculated by the following equation (VI).

$$\text{Specific resistance } SR = \frac{a}{l} R \quad \text{(VI)}$$

l: Length of sample (cm)
a: Cross-sectional area of sample ($cm^2$)
R: Electric resistance (Ω) of sample.

The following examples are given for the purpose of illustration of this invention and are not intended as limitations thereof. In the examples, "parts" and "%" in mixing amounts mean by weight unless otherwise indicated.

EXAMPLE 1

A mixture of 100 parts of zinc oxide powder having an average grain size of 0.08 μm, 2 parts of aluminum oxide power having an average grain size of 0.02 μm and 2 parts of aluminum monoxide powder was homogeneously mixed, and the resulting mixture was heated at 1,000° C. for 1 hour under a nitrogen atmosphere containing 1% of carbon monoxide under stirring, and then cooled. The resulting power was pulverized to obtain conductive zinc oxide fine particles $Z_1$, which had an average grain size of 0.12 μm, a specific resistance of 33 Ω·cm, a whiteness of 85% and a substantially white (slightly greyish blue) color.

Low-density polyethylene having a molecular weight of about 50,000, a melting point of 102° C. and a crystallinity of 37% is referred to as polymer $P_1$. High-density polyethylene having a molecular weight of about 48,000, a melting point of 130° C. and a crystallinity of 77% is referred to as polymer $P_2$.

Polyethylene oxide having a molecular weight of about 63,000, a crystallinity of 85% and a melting point of 55° C. is referred to as polymer $P_3$. Polyetherester having a molecular weight of about 75,000 is referred to as polymer $P_4$, which is a viscous liquid (crystallinity: 0%) at room temperature and has been produced by copolymerizing 90 parts of a random copolymer consisting of 75 parts of ethylene oxide unit and 25 parts of propylene oxide unit and having a molecular weight of about 20,000 with 10 parts of bishydroxyethyl terephthalate in the presence of a catalyst of antimony trioxide (600 ppm) at 245° C. for 6 hours under a reduced pressure of 0.5 Torr.

Nylon-6 having a molecular weight of about 16,000, a melting point of 220° C. and a crystallinity of 45% is referred to as polymer $P_5$.

Each of polymers $P_1$–$P_5$ was kneaded together with the above obtained conductive particles $Z_1$ to produce a conductive polymer mixture containing the conductive particle $Z_1$ in a mixed ratio of 60% or 75%, which was used as a core component. Polymer $P_5$ was mixed with 1%, based on the amount of the polymer, of titanium oxide to produce a titanium oxide-containing polymer, which was used as a sheath component. The conductive polymer mixture as a core component, and the titanium oxide-containing polymer as a sheath component were conjugate spun into a composite filament having a cross-sectional structure as shown in FIG. 2 in a conjugate ratio of 1/10 (cross-sectional area ratio) through orifices having a diameter of 0.3 mm and kept at 270° C., the extruded filaments were taken up on a bobbin at a rate of 1,000 m/min while cooling and oiling, and the taken-up filaments were drawn to 3.1 times their original length on a draw pin kept at 80° C. to obtain drawn composite filament yarns $Y_1$–$Y_{10}$ of 20 deniers/3 filaments. The polymer of the core component, the mixed ratio of the conductive particle in each filament and the electric resistance per 1 cm length of monofilament are shown in the following Table 1. All the resulting yarns had a whiteness of about 85%.

TABLE 1

| Yarn | Core: Polymer | Core: Mixed ratio of conductive particle (%) | Sheath polymer | Electric resistance (Ω/cm) |
|---|---|---|---|---|
| $Y_1$ | $P_1$ | 60 | $P_5$ | $5.2 \times 10^{13}$ |
| $Y_2$ | " | 75 | " | $6.0 \times 10^{12}$ |
| $Y_3$ | $P_2$ | 60 | " | $3.3 \times 10^{11}$ |
| $Y_4$ | " | 75 | " | $1.0 \times 10^{10}$ |
| $Y_5$ | $P_3$ | 60 | " | $84 \times 10^{10}$ |
| $Y_6$ | " | 75 | " | $1.5 \times 10^{9}$ |
| $Y_7$ | $P_4$ | 60 | " | $7.0 \times 10^{13}$ |
| $Y_8$ | " | 75 | " | $2.8 \times 10^{14}$ |
| $Y_9$ | $P_5$ | 60 | " | $2.2 \times 10^{12}$ |
| $Y_{10}$ | " | 75 | " | $6.0 \times 10^{10}$ |

Each of the above obtained yarns $Y_1$–$Y_{10}$ was doubled with crimped nylon-6 yarn (2,600 d/140 f), and the doubled yarn was subjected to a crimping treatment. A tufted carpet (loop) was produced by using the doubled yarn in one course, out of four courses, and the nylon-6 crimped yarn (2,600 d/140 f) in other three courses. A charged voltage of a human body generated when a man put on leather shoes and walked (25° C., 20% RH) on the resulting carpet was measured. The obtained results are shown in the following Table 2. For comparison, the charged voltage of a human body generated when a man put on leather shoes and walked on a carpet produced from nylon-6 crimped yarn only is also shown in Table 2.

TABLE 2

| Yarn used | Charged voltage of human body (V) |
|---|---|
| $Y_1$ | −5,800 |
| $Y_2$ | −2,100 |
| $Y_3$ | −1,900 |
| $Y_4$ | −1,900 |
| $Y_5$ | −1,700 |
| $Y_6$ | −1,500 |
| $Y_7$ | −6,000 |
| $Y_8$ | −6,300 |
| $Y_9$ | −2,100 |
| $Y_{10}$ | −2,000 |
| Nylon-6 only | −7,500 |

Note: Charged voltage of human body is preferably not higher than 3,000 V (absolute value), and particularly preferably not higher than 2,500 V.

The above described yarns $Y_1$–$Y_4$ were relaxed by 3% and heat treated at 150° C. to produce heat treated yarns $HY_1$–$HY_4$, respectively. The yarns $HY_1$–$HY_4$ had an electric resistance shown in the following Table 3 and had a fairly improved conductivity.

TABLE 3

| Yarn | Electric resistance (Ω/cm) |
|---|---|
| $HY_1$ | $1.2 \times 10^{12}$ |
| $HY_2$ | $5.8 \times 10^{10}$ |
| $HY_3$ | $1.1 \times 10^{10}$ |
| $HY_4$ | $6.4 \times 10^{8}$ |

EXAMPLE 2

Conductive zinc oxide fine particles $Z_2$–$Z_4$ having different average grain sizes from each other were produced in substantially the same manner as described in the production of conductive particle $Z_1$ in Example 1, except that zinc oxide raw material powders having different particle sizes were used. The resulting zinc oxide fine particles $Z_2$–$Z_4$ had substantially the same specific resistance of about $3 \times 10^2$ Ω·cm with each other, and further had a whiteness of 85%. The average grain sizes of the resulting conductive zinc oxide fine particles are shown in the following Table 4.

TABLE 4

| Particles | Average grain size (μm) |
|---|---|
| $Z_2$ | 1.5 |
| $Z_3$ | 0.7 |
| $Z_4$ | 0.3 |

Polymer $P_5$ described in Example 1 was mixed with each of the above obtained conductive fine particles $Z_2$–$Z_4$ to produce conductive mixture polymers containing the conductive fine particles in a mixed ratio of 60% or 75%. Drawn yarns $Y_{11}$–$Y_{16}$ were produced in the same manner as described in the production of yarns $Y_9$ and $Y_{10}$ of Example 1, except that the above obtained conductive mixture polymer and the titanium oxide-containing polymer used in Example 1 were conjugate spun into a three-layered composite filament having a cross-sectional structure shown in FIG. 13 in a conjugate ratio of 1/7. The resulting yarns $Y_{11}$–$Y_{16}$ had an electric resistance as shown in the following Table 5. The resulting yarns contain zinc oxide particles having grain sizes larger than that of the zinc oxide particles used in yarns $Y_9$ and $Y_{10}$ of Example 1, and therefore the above obtained yarns are likely to be inferior to yarns $Y_9$ and $Y_{10}$ in the conductivity.

TABLE 5

| Yarn | Conductive particle: Kind | Conductive particle: Mixed ratio (%) | Electric resistance (Ω/cm) |
|---|---|---|---|
| $Y_{11}$ | $Z_2$ | 60 | $9.5 \times 10^{14}$ |
| $Y_{12}$ | " | 75 | $4.1 \times 10^{13}$ |
| $Y_{13}$ | $Z_3$ | 60 | $7.0 \times 10^{13}$ |
| $Y_{14}$ | " | 75 | $2.2 \times 10^{12}$ |
| $Y_{15}$ | $Z_4$ | 60 | $5.5 \times 10^{12}$ |
| $Y_{16}$ | " | 75 | $1.8 \times 10^{11}$ |

In general, yarns having a resistance of higher than $10^{13}$ Ω/cm are insufficient as a conductive yarn, and yarns having a resistance of not higher than $10^{12}$ Ω/cm, particularly not higher than $10^{11}$ Ω/cm, are preferably used.

EXAMPLE 3

A mixture consisting of the same particle $Z_1$ and polymer $P_1$ as described in Example 1 and containing the particle $Z_1$ in a mixed ratio of 70% was used as a core component, and polyethylene terephthalate (PET) having a molecular weight of about 18,000 was used as a sheath component. The core and sheath polymers were bonded into a composite structure as shown in FIG. 3 in a conjugate ratio of 1/9 and extruded through orifices having a diameter of 0.25 mm and kept at 278° C. The extruded filaments were taken up on a bobbin at a rate of 1,500 m/min while oiling, and the taken-up filaments were drawn to 3.01 times their original length at 80° C. and then heat treated at 180° C. under tension to obtain a drawn composite filament yarn $Y_{17}$ of 30 deniers/6 filaments. The yarn $Y_{17}$ had an electric resistance of monofilament of $5.2\times10^{10}$ Ω/cm.

EXAMPLE 4

Drawn yarns $Y_{18}$–$Y_{19}$ were produced in the same manner as described in Example 1, except that conductive tin oxide particle $S_1$ having a specific resistance of 12 Ω·cm, an average grain size of 0.07 μm, a whiteness of 66% and a light greyish blue color, which was produced by mixing 100 parts of tin oxide ($SnO_2$) powder with 10 parts of antimony oxide ($Sb_2O_3$) powder, and firing the resulting mixture under a reducing atmosphere, was used in place of the conductive zinc oxide fine particle $Z_1$ used in Example 1. The kind of core polymer, the mixed ratio of the conductive particle in the core polymer in each composite filament and the electric resistance per 1 cm length of monofilament are shown in the following Table 6. All the resulting yarns were substantially white (whiteness: 75%) and very slightly greyish blue. Even when the yarn was mixed with other usual yarns, the mixing was not noticed.

TABLE 6

| | Core | | | |
|---|---|---|---|---|
| Yarn | Polymer | Mixed ratio of conductive particle (%) | Sheath polymer | Electric resistance (Ω/cm) |
| $Y_{18}$ | $P_1$ | 60 | $P_5$ | $1.1\times10^{14}$ |
| $Y_{19}$ | " | 75 | " | $1.8\times10^{12}$ |
| $Y_{20}$ | $P_2$ | 60 | " | $5.0\times10^{11}$ |
| $Y_{21}$ | " | 75 | " | $2.8\times10^{10}$ |
| $Y_{22}$ | $P_3$ | 60 | " | $7.6\times10^{10}$ |
| $Y_{23}$ | " | 75 | " | $6.2\times10^{9}$ |
| $Y_{24}$ | $P_4$ | 60 | " | $1.2\times10^{14}$ |
| $Y_{25}$ | " | 75 | " | $4.5\times10^{14}$ |
| $Y_{26}$ | $P_6$ | 60 | " | $3.3\times10^{13}$ |
| $Y_{27}$ | " | 75 | " | $2.0\times10^{11}$ |

Each of yarns $Y_{18}$–$Y_{27}$ was knitted into a tufted carpet (loop), and the charged human body voltage generated by the carpet was measured in the same manner as described in Example 1. The obtained results are shown in the following Table 7.

TABLE 7

| Yarn used | Charged voltage of human body (V) |
|---|---|
| $Y_{18}$ | −6,100 |
| $Y_{19}$ | −2,500 |
| $Y_{20}$ | −1,900 |
| $Y_{21}$ | −1,800 |
| $Y_{22}$ | −1,800 |
| $Y_{23}$ | −1,700 |
| $Y_{24}$ | −6,600 |
| $Y_{25}$ | −6,500 |
| $Y_{26}$ | −6,700 |
| $Y_{27}$ | −1,800 |
| Nylon-6 only | −7,500 |

The above described yarns $Y_{18}$–$Y_{21}$ were relaxed by 3% and heat treated at 150° C. to obtain heat treated yarns $HY_{18}$–$HY_{21}$. Yarns $HY_{18}$–$HY_{21}$ had an electric resistance shown in the following Table 8. It can be seen from Tables 6 and 8 that the conductivity of the composite filament yarn of the present invention is considerably improved by the heat treatment.

TABLE 8

| Yarn | Electric resistance (Ω/cm) |
|---|---|
| $HY_{18}$ | $2.1\times10^{11}$ |
| $HY_{19}$ | $8.7\times10^{10}$ |
| $HY_{20}$ | $6.0\times10^{9}$ |
| $HY_{21}$ | $5.2\times10^{8}$ |

EXAMPLE 5

A mixture consisting of particles $S_1$ produced in Example 4 and polymer $P_2$ described in Example 1, which contained particle $S_1$ in a mixed ratio of 70%, was used as a core component, and PET having a molecular weight of about 18,000 was used as a sheath component. The core and sheath components were bonded into a composite structure as shown in FIG. 3 in a conjugate ratio of 1/9, extruded through orifices having a diameter of 0.25 mm and kept at 278° C. The extruded filaments were taken up on a bobbin at a rate of 1,500 m/min while oiling, and the taken-up filaments were drawn to 3.01 times their original length at 80° C. and then heat treated at 180° C. under tension to obtain a drawn composite filament yarn $Y_{28}$ of 30 deniers/6 filaments. The yarn $Y_{28}$ had an electric resistance of monofilament of $3.9\times10^{10}$ Ω/cm. The above obtained drawn yarn which was not heat treated had an electric resistance of monofilament of $9.0\times10^{12}$ Ω/cm.

EXAMPLE 6

Titanium oxide particles having an average grain size of 0.04 μm and coated with a tin oxide, the amount of tin oxide being about 12% based on the total amount of the titanium oxide and tin oxide, were mixed with 5%, based on the amount of the titanium oxide particles coated with the tin oxide, of antimony oxide particles having a grain size of 0.02 μm, and the resulting mixture was fired to obtain conductive particle $A_1$. The conductive particle $A_1$ had an average grain size of 0.05 μm, a specific resistance of 9 Ω·cm, a whiteness of 85% and a substantially white (slightly greyish blue) color.

A mixture consisting of polymer $P_5$ described in Example 1 and the above obtained particle $A_1$ containing the particles $A_1$ in a mixed ratio of 60% or 70%, was used as a conductive component. Polymer $P_5$ was mixed with 5%, based on the amount of polymer $P_5$, of titanium oxide, and the resulting mixture was used as a non-conductive component. Both the components were bonded into a composite structure as shown in FIG. 13 in a conjugate ratio of ⅛, and then extruded and drawn in substantially the same manner as described in Example 1 to obtain yarns $Y_{29}$ and $Y_{30}$, respectively. Yarns $Y_{29}$ and $Y_{30}$ had electric resistances of $1.1\times10^{11}$ Ω/cm and $8.5\times10^{9}$ Ω/cm respectively, and had a whiteness of 80%.

EXAMPLE 7

Titanium oxide particles coated with a tin oxide ($SnO_2$) formed on the surfaces thereof were mixed with 0.75%, based on the amount of the titanium oxide particles coated with tin oxide, of antimony oxide, and the resulting mixture was fired to obtain conductive particle $A_2$. Particle $A_2$ had an average grain size of 0.25 μm (range of grain size: 0.20–0.30 μm, relatively uniform), a tin oxide content of 15%, a specific resistance of 6.3 Ω·cm, a whiteness (light reflectivity) of 86% and a substantially white and light greyish blue color.

Zinc oxide particles were mixed with 3%, based on the amount of the zinc oxide, of aluminum oxide, and the resulting mixture was fired to obtain conductive particle $A_3$. Particle $A_3$ had an average grain size of 0.20 μm (range of grain size: 0.15–0.50 μm), a specific resistance of 33 Ω·cm, a whiteness of 81% and a substantially white and light greyish blue color.

The above obtained conductive particle $A_2$ or $A_3$ was mixed with various polymers shown in the following Table 9.

TABLE 9

| Mark of polymer | Kind of polymer | Molecular weight | Melting point (°C.) | Crystallinity after drawing: Density | Crystallinity after drawing: Crystallinity (%) |
|---|---|---|---|---|---|
| $P_6$ | polyethylene | 80,000 | 135 | 0.960 | 78 |
| $P_7$ | polyethylene | 60,000 | 112 | 0.908 | 47 |
| $P_8$ | polypropylene | 70,000 | 175 | 0.915 | 78 |
| $P_9$ | nylon-6 | 14,000 | 220 | 1.146 | 45 |

Powders of polymers $P_6$–$P_9$ were mixed with conductive particles $A_2$ and $A_3$ in various combinations such that the resulting mixture would contain the conductive particle in a mixed ratio of 75%, and the mixture was melted and kneaded to obtain 8 kinds of conductive polymers shown in the following Table 10. When the conductive particle was mixed with polymers $P_6$–$P_8$, a block copolymer of polyethylene oxide and polypropylene oxide in a copolymerization ratio of 3/1, which copolymer had a molecular weight of 4,000, was used as a particle-dispersing agent in an amount of 0.3% based on the amount of the conductive particle. When the conductive particle was mixed with polymer $P_9$, magnesium stearate was used as a dispersing agent in an amount of 0.5% based on the amount of the conductive particle.

TABLE 10

| Conductive polymer | Polymer | Conductive particle |
|---|---|---|
| $CP_{62}$ | $P_6$ | $A_2$ |
| $CP_{63}$ | $P_6$ | $A_3$ |
| $CP_{72}$ | $P_7$ | $A_2$ |
| $CP_{73}$ | $P_7$ | $A_3$ |
| $CP_{82}$ | $P_8$ | $A_2$ |
| $CP_{83}$ | $P_8$ | $A_3$ |
| $CP_{92}$ | $P_9$ | $A_2$ |

TABLE 10-continued

| Conductive polymer | Polymer | Conductive particle |
|---|---|---|
| $CP_{93}$ | $P_9$ | $A_3$ |

Nylon-6 having a molecular weight of 16,000 was mixed with 1.8%, based on the amount of the nylon-6, of titanium oxide particle as a delusterant. The titanium oxide-containing nylon-6 was used as a non-conductive component, and the above obtained conductive polymer $CP_{62}$ was used as a conductive component, and both the components were melted and conjugate spun into a composite filament having a composite structure as shown in FIG. 8. That is, both the components were bonded in a conjugate ratio (volume ratio) of 19/1 and extruded through orifices having a diameter of 0.25 mm and kept at 255° C., and the extruded filaments were taken up on a bobbin at a rate of 800 m/min with cooling and oiling, and then drawn to 3.1 times their original length at 85° C. to obtain a drawn composite filament yarn of 30 d/4 f, which was referred to as yarn $Y_{31}$. In yarn $Y_{31}$, the ratio of surface area occupied by the conductive layer (2) is about 2.5%.

In the same manner as described in the production of yarn $Y_{31}$, the above described delusterant-containing nylon-6 and various conductive polymers shown in Table 10 were conjugate spun, and the conductive properties of the resulting undrawn composite filament yarns and drawn composite filament yarns are shown in the following Table 11.

TABLE 11

| Yarn | Polymer for non-conductive component | Polymer for conductive component | Undrawn yarn: Resistance of monofilament (Ω/cm) | Undrawn yarn: Specific resistance (Ω · cm) | Drawn yarn: Resistance of monofilament (Ω/cm) | Drawn yarn: Specific resistance (Ω · cm) | Drawn yarn: Whiteness (%) | Remarks |
|---|---|---|---|---|---|---|---|---|
| $Y_{31}$ | Nylon-6 | $CP_{62}$ | $5.1 \times 10^8$ | $6.1 \times 10^2$ | $2.2 \times 10^{10}$ | $8.6 \times 10^3$ | 76 | Yarn of this invention |
| $Y_{32}$ | " | $CP_{63}$ | $1.0 \times 10^9$ | $1.2 \times 10^3$ | $1.5 \times 10^{12}$ | $5.9 \times 10^5$ | 87 | Yarn of this invention |
| $Y_{33}$ | " | $CP_{72}$ | $4.2 \times 10^{11}$ | $5.0 \times 10^5$ | $3.3 \times 10^{14}$ | $1.3 \times 10^8$ | 78 | Comparative yarn |
| $Y_{34}$ | " | $CP_{73}$ | $5.3 \times 10^{12}$ | $6.4 \times 10^6$ | $2.0 \times 10^{15}$ | $7.5 \times 10^8$ | 88 | Comparative yarn |
| $Y_{35}$ | " | $CP_{82}$ | $2.1 \times 10^8$ | $2.5 \times 10^2$ | $8.3 \times 10^{10}$ | $3.2 \times 10^4$ | 79 | Yarn of this invention |
| $Y_{36}$ | " | $CP_{83}$ | $4.5 \times 10^9$ | $5.4 \times 10^4$ | $9.0 \times 10^{11}$ | $3.5 \times 10^5$ | 88 | Yarn of this invention |
| $Y_{37}$ | " | $CP_{92}$ | $3.3 \times 10^{11}$ | $3.1 \times 10^5$ | $1.0 \times 10^{15}$ | $3.1 \times 10^8$ | 75 | Comparative yarn |
| $Y_{38}$ | " | $CP_{93}$ | $9.0 \times 10^{11}$ | $8.6 \times 10^5$ | $2.2 \times 10^{15}$ | $6.8 \times 10^8$ | 86 | Comparative yarn |

EXAMPLE 8

PET having a molecular weight of 15,000, a crystallinity after heat treatment of 46% and a melting point of 257° C. is referred to as polymer $P_{10}$. A conductive polymer, which has been obtained by melting and kneading polymer $P_{10}$ together with conductive particle $A_2$ or $A_3$ of Example 7 and containing the conductive particle in a mixed ratio of 75%, is referred to as conductive polymer $CP_{102}$ or $CP_{103}$, respectively. In the production of the conductive polymer, the (polyethylene oxide)/(polypropylene oxide) block copolymer described in Example 1 was used as a dispersing agent in an amount of 0.3% based on the amount of the conductive particle.

PET having a molecular weight of 15,000 and mixed with 0.7% based on the amount of the PET, of titanium oxide particles as a delusterant was used as a non-conductive component, and the above obtained conductive polymer $CP_{102}$ was used as a conductive component. Both the non-conductive and conductive components were melted and conjugate spun to produce a composite filament having a composite structure as shown in FIG. 10. That is, both the components were bonded in a conjugate ratio (volume ratio) of 11/1 and extruded through orifices having a diameter of 0.25 mm and kept at 275° C., and the extruded filaments were taken up on a bobbin at a rate of 1,400 m/min, drawn to 3.2 times their original length at 90° C., contacted with a heater kept at 150° C. under tension and then taken up on a bobbin to obtain a drawn yarn of 25 deniers/5 filaments, which was referred to as yarn $Y_{45}$. For yarn $Y_{45}$, the ratio of surface area occupied by the conductive layer (2) is about 3.5%. A drawn yarn was produced by using conductive polymer $CP_{103}$ in the same manner as described in the production of yarn $Y_{45}$, and is referred to as yarn $Y_{46}$.

Further, the above described PET was used as a non-conductive component, the conductive polymer $CP_{62}$, $CP_{63}$, $CP_{72}$, $CP_{73}$, $CP_{82}$ or $CP_{83}$ was used as a conductive component, and drawn yarns $Y_{39}$, $Y_{40}$, $Y_{41}$, $Y_{42}$, $Y_{43}$ and $Y_{44}$ were produced respectively in the same manner as described above. The conductivity of the undrawn yarns and that of drawn and heat treated yarns $Y_{39}$–$Y_{46}$ are shown in the following Table 12.

TABLE 12

| Yarn | Polymer for non-conductive component | Polymer for conductive component | Undrawn yarn: Resistance of mono-filament (Ω/cm) | Undrawn yarn: Specific resistance (Ω · cm) | Drawn yarn: Resistance of mono-filament (Ω/cm) | Drawn yarn: Specific resistance (Ω · cm) | Whiteness (%) | Remarks |
|---|---|---|---|---|---|---|---|---|
| $Y_{39}$ | PET | $CP_{62}$ | $2.1 \times 10^8$ | $2.1 \times 10^2$ | $1.2 \times 10^{10}$ | $3.7 \times 10^3$ | 77 | Yarn of this invention |
| $Y_{40}$ | " | $CP_{63}$ | $3.5 \times 10^9$ | $3.5 \times 10^3$ | $3.9 \times 10^{11}$ | $1.2 \times 10^5$ | 85 | Yarn of this invention |
| $Y_{41}$ | " | $CP_{72}$ | $3.3 \times 10^{11}$ | $3.3 \times 10^5$ | $7.5 \times 10^{14}$ | $2.3 \times 10^8$ | 77 | Comparative yarn |
| $Y_{42}$ | " | $CP_{73}$ | $4.0 \times 10^{12}$ | $4.0 \times 10^6$ | $9.9 \times 10^{14}$ | $3.1 \times 10^8$ | 86 | Comparative yarn |
| $Y_{43}$ | " | $CP_{82}$ | $1.4 \times 10^8$ | $1.4 \times 10^2$ | $1.2 \times 10^{10}$ | $3.7 \times 10^3$ | 75 | Yarn of this invention |
| $Y_{44}$ | " | $CP_{83}$ | $6.6 \times 10^9$ | $6.5 \times 10^3$ | $8.4 \times 10^{10}$ | $2.6 \times 10^4$ | 85 | Yarn of this invention |
| $Y_{45}$ | " | $CP_{102}$ | $6.9 \times 10^{10}$ | $6.8 \times 10^4$ | $3.2 \times 10^{14}$ | $1.0 \times 10^8$ | 78 | Comparative yarn |
| $Y_{46}$ | " | $CP_{103}$ | $9.8 \times 10^{10}$ | $9.7 \times 10^4$ | $2.5 \times 10^{15}$ | $7.8 \times 10^8$ | 85 | Comparative yarn |

EXAMPLE 9

Titanium oxide particles having an average grain size of 0.05 μm and coated with a zinc oxide film were mixed with 4%, based on the amount of the zinc oxide-coated titanium oxide particles, of aluminum oxide fine particles having a grain size of 0.02 μm, and the resulting mixture was fired to obtain conductive powder having an average grain size of 0.06 μm, a specific resistance of 12 Ω·cm, a whiteness of 86% and a substantially white and slightly greyish blue color.

A DMF solution of an acrylic copolymer having a molecular weight of 53,000 and a composition of acrylonitrile:methyl acrylate:sodium methallylsulfonate=90.4:9:0.6(%) was produced by a solution polymerization process. The above obtained conductive powder was added to the DMF solution such that the mixed ratio of the conductive powder would be 60% or 75% based on the total amount of the solid content in the resulting mixture, and the resulting mixture was homogeneously stirred to produce a solution $L_1$ or $L_2$ having a solid content of 40% or 51%, respectively. A 23% DMF solution $L_0$ of the same acrylic copolymer as described above was produced, and solutions $L_1$ and $L_0$, or solutions $L_2$ and $L_0$ were conjugate spun through a spinneret into a 60% aqueous solution of DMF kept at 20° C. in a three-layered side-by-side relation and in a conjugate ratio of 1/9 (cross-sectional area ratio). The spun filaments were primarily drawn to 4.5 times their original length, and the primarily drawn filaments were washed with water, dried, secondarily drawn to 1.4 times their original length at 115° C., and then heat treated at 120° C. in a relaxed state. The resulting composite filament yarn had a specific resistance of $6 \times 10^3$ Ω·cm or $7 \times 10^2$ Ω·cm when the mixed ratio of the conductive particles was 60% or 75% respectively, and both the yarns had excellent conductivity. Further, both the yarns had a whiteness of 73%.

EXAMPLE 10

A DMF solution of an acrylic copolymer having the same composition as described in Example 9 was mixed with conductive particle $A_1$ produced in Example 6 such that the mixed ratio of conductive particle $A_1$ was 60% based on the total amount of the solid content in the resulting solution, to produce a solution $L_3$ having a solid content of 50%, which was used as a core-component solution. A DMF solution $L_0$ of the same acrylic copolymer as described above was used as a sheath-component solution. Solutions $L_3$ and $L_0$ were conjugated spun into a 60% aqueous solution of DMF kept at 20° C. in a conjugate ratio of 1/10, and the spun filaments were primarily drawn to 4.5 times their original length. The primarily drawn filaments were washed with water, dried and then secondarily drawn to 1.3 times their original length at 105° C., and the secondarily drawn filaments were subjected to a wet heat treatment at a temperature shown in the following Table 13 in a tensionless state. The specific resistance of the above treated filament yarn is shown in Table 13.

TABLE 13

| Yarn | Heat treatment temperature (°C.) | Specific resistance (Ω · cm) |
|---|---|---|
| $Y_{47}$ | not treated | $3 \times 10^5$ |
| $Y_{48}$ | 100 | $8 \times 10^3$ |
| $Y_{49}$ | 110 | $4 \times 10^3$ |
| $Y_{50}$ | 120 | $7 \times 10^2$ |
| $Y_{51}$ | 130 | $5 \times 10^2$ |

EXAMPLE 11

A mixture of 100 parts of zinc oxide powder having an average grain size of 0.08 μm and 2 parts of aluminum oxide powder having an average grain size of 0.02 μm was homogeneously mixed, and the resulting mixture was heated at 1,000° C., for 1 hour while stirring under a nitrogen atmosphere containing 1% of carbon monoxide, and then cooled. The resulting powder was pulverized to obtain conductive zinc oxide fine particles having an average grain size of 0.12 μm, a specific resistance of 33 Ω·cm, a whiteness of 85% and a substantially white and slightly greyish blue color.

The same acrylic copolymer as used in Example 10 was conjugate spun into an aqueous solution of DMF in the same manner as described in Example 10, except that the above obtained conductive zinc oxide fine particle was used. The spun filaments were primarily drawn to 6 times their original length, and the primarily drawn filaments were washed with water, dried and heat treated at 120° C. in a relaxed state. The resulting composite filament yarn had a specific resistance of $1\times10^5$ Ω·cm or $3\times10^3$ Ω·cm when the mixed ratio of the conductive particle was 60% or 75% respectively, and had excellent conductivity.

EXAMPLE 12

A DMF solution of an acrylic copolymer having a molecular weight of 53,000 and a composition of acrylonitrile:methyl acrylate:sodium methallylsulfonate=90.4:9:0.6(%) was produced by a solution polymerization process. Conductive particle $S_1$ produced in Example 4 was added to the DMF solution such that the mixed ratio of the conductive particle would be 50% or 65% based on the total amount of the solid content in the resulting mixture, and the resulting mixture was homogeneously stirred to prepare a solution $L_4$ or $L_5$ having a solid content of 40% or 50%, respectively. A 23% DMF solution $L_6$ of the same acrylic copolymer as described above was produced, and solutions $L_4$ and $L_6$, or solutions $L_5$ and $L_6$ were conjugate spun through a spinneret into a 60% aqueous solution of DMF kept at 20° C. in a three-layered side-by-side relation and in a conjugate ratio of 1/9 (cross-sectional area ratio). The spun filaments were primarily drawn to 4.5 times their original length, and the primarily drawn filaments were washed with water, dried, secondarily drawn to 1.4 times their original length at 115° C. and heat treated at 120° C. in a relaxed state. The resulting composite filament yarn had a specific resistance of $8\times10$ Ω·cm or $1\times10$ Ω·cm when the mixed ratio of the conductive particle was 50% or 65% respectively, and had excellent conductivity. Further, both the yarns had a whiteness of 77% and a substantially white and very slightly greyish blue color, and even when the yarns were mixed with other ordinary fibers, the mixing was not noticed.

EXAMPLE 13

A mixture of 75 parts of conductive particle $A_2$ produced in Example 7, 24.5 parts of nylon-12 having a crystallinity of 40% and a molecular weight of 14,000, and 0.5 part of magnesium stearate was melted and kneaded to produce a conductive polymer. The resulting conductive polymer and the above described nylon-12 were melted and conjugate spun into a composite filament having a cross-sectional structure as shown in FIG. 13 at a spinning temperature of 260° C. and at a spinning velocity of 600 m/min. The resulting undrawn yarn of 60 deniers/4 filaments were drawn in various draw ratios on a draw pin kept at 85° C., and the draw yarn was contacted with a hot plate kept at 150° C. and then taken up on a bobbin.

The various properties of the undrawn and drawn yarns are shown in the following Table 14.

The antistatic property of the yarn was estimated in the following manner. A sample composite filament yarn was doubled with a highly oriented nylon-6 drawn yarn of 160 deniers/32 filaments at a number of twists of 80 T/m. Nylon-6 drawn yarn of 210 deniers/54 filaments was knitted into a circular knitted fabric by arranging the above obtained doubled yarn at an interval of 6 mm, and the resulting circular knitted fabric was rubbed with a cotton cloth under conditions of 25° C. and 33% RH. 10 seconds after the rubbing, the charged voltage of the circular knitted fabric due to friction was measured, and the antistatic property of the knitted fabric was estimated from the charged voltage. The lower the charged voltage due to friction, the more excellent the antistatic property is, and a charged voltage of not higher than 2 kV is most preferable. The relation between the draw ratio, specific resistance and charged voltage due to friction is illustrated in FIG. 18.

TABLE 14

| Draw ratio | Orientation degree (%) | Specific resistance (Ω · cm) | Charged voltage (kV) | Strength (g/d) | Elongation (%) | Remarks |
|---|---|---|---|---|---|---|
| 1.00 | 64 | $4.1 \times 10^3$ | 1.7 | 1.0 | 370 | Yarn of this invention |
| 1.26 | 70 | $3.5 \times 10^2$ | 1.6 | 1.2 | 230 | Yarn of this invention |
| 1.46 | 76 | $1.1 \times 10^3$ | 1.6 | 1.3 | 200 | Yarn of this invention |
| 1.67 | 81 | $1.5 \times 10^4$ | 1.5 | 1.5 | 160 | Yarn of this invention |
| 1.81 | 84 | $1.6 \times 10^5$ | 1.5 | 1.8 | 150 | Yarn of this invention |
| 2.02 | 86 | $2.9 \times 10^7$ | 1.5 | 2.0 | 110 | Yarn of this invention |
| 2.24 | 88 | $7.0 \times 10^7$ | 1.7 | 2.3 | 95 | Yarn of this invention |
| 2.43 | 89 | $6.1 \times 10^7$ | 2.2 | 2.5 | 80 | Yarn of this invention |
| 2.63 | 90 | $1.0 \times 10^8$ | 4.3 | 2.7 | 55 | Comparative yarn |
| 2.85 | 91 | $1.8 \times 10^8$ | 8.7 | 2.9 | 40 | Comparative yarn |
| 3.25 | 90 | $2.9 \times 10^8$ | 12.0 | 3.0 | 30 | Comparative yarn |

EXAMPLE 14

A mixture of 75 parts of conductive particle $A_2$ produced in Example 7, 24.5 parts of nylon-6 having a molecular weight of 17,000 and a crystallinity of 44%, and 0.5 part of a random copolymer of (polyethylene oxide)/(polypropylene oxide)=3/1 (weight ratio), which had a molecular weight of 4,000, was melted and kneaded to produce a conductive polymer.

The above obtained conductive polymer was used as a conductive component, and the above described nylon-6 mixed with 0.8%, based on the amount of the nylon-6, of titanium oxide particles, was used as a non-conductive component. Both the components were melted and conjugate spun in a conjugate ratio of 1/15 into a composite filament having a cross-sectional structure as shown in FIG. 8. In the spinning, after the bonding of both the components, the bonded components were spun through orifices having a diameter of 0.25 mm and kept at 265° C., cooled and taken up on a bobbin in various take-up rates while oiling. The taken-up filaments were drawn on a draw pin kept at 90° C. in various draw ratios, and heat treated at 160° C. Relations between the spinning condition, draw ratio and various properties of the resulting yarn are shown in the following Table 15.

TABLE 15

| Spinning velocity (m/min) | Spinning tension (g/d) | Draw ratio | Orientation degree (%) | Specific resistance (Ω · cm) | Strength (g/d) | Elongation (%) |
|---|---|---|---|---|---|---|
| 1,000 | 0.05 | 1.00 | 66 | $5.1 \times 10^3$ | 1.1 | 330 |
| " | " | 1.46 | 74 | $3.5 \times 10^5$ | 1.6 | 190 |
| " | " | 2.02 | 79 | $7.0 \times 10^7$ | 2.5 | 90 |
| 2,000 | 0.07 | 1.00 | 78 | $1.4 \times 10^4$ | 2.2 | 120 |
| " | " | 1.26 | 82 | $1.8 \times 10^5$ | 2.8 | 92 |
| " | " | 1.46 | 88 | $6.8 \times 10^6$ | 2.9 | 71 |
| 3,000 | 0.19 | 1.00 | 86 | $8.9 \times 10^4$ | 2.5 | 88 |
| " | " | 1.26 | 88 | $1.0 \times 10^6$ | 2.9 | 63 |
| " | " | 1.46 | 91 | $7.2 \times 10^6$ | 3.2 | 40 |
| 4,000 | 0.34 | 1.00 | 91 | $1.1 \times 10^5$ | 3.1 | 70 |
| " | " | 1.26 | 92 | $1.8 \times 10^7$ | 3.5 | 51 |
| 6,000 | 0.51 | 1.00 | 92 | $3.9 \times 10^5$ | 3.5 | 62 |
| " | " | 1.26 | 92 | $2.6 \times 10^7$ | 3.7 | 48 |

The above described experiment was repeated, except that a copolyester having a molecular weight of 16,000 and a crystallinity of 43%, which was obtained by copolymerizing polyethylene terephthalate with 5% of polyethylene oxide having a molecular weight of 600, was used in place of the nylon-6, and high speed spinning was carried out at a spinning velocity of at least 2,000 m/min to obtain an undrawn yarn. The undrawn yarn was drawn at a draw ratio of not higher than 2.0. Both the resulting undrawn yarn and drawn yarn had sufficiently high antistatic property (specific resistance of not higher than $7 \times 10^7$ Ω·cm) and strength (not less than 2 g/d).

What is claimed is:

1. A unitary, elongated, electrically conductive, bicomponent filament which in transverse cross-section consists essentially of an electrically conductive component in the form of one or more relatively thin, elongated layers which extend transversely of the cross-section of the filament and the remainder of the filament being an electrically non-conductive component, said electrically conductive component being made of a mixture of electrically conductive metal oxide particles with at least one polymer having a crystallinity of not less than 60%, said polymer being selected from the group consisting of thermoplastic polymers and solvent-soluble polymers, said electrically non-conductive component being made of a thermoplastic fiber-forming polymer, said polymer used to form said electrically conductive component being poor in affinity to said fiber-forming polymer, at least one exposed end of each said layer being exposed on the outer surface of the filament, the opposite surfaces of each said layer being adhered to said electrically non-conductive component, the thickness of each said layer throughout substantially all of its length being at least as great as the thickness of said layer at said exposed end so as to prevent separation of said electrically conductive component from said electrically non-conductive component, said layer or layers having a specific resistance of not more than $10^7$ ohm·cm, said layer or layers occupying from 1 to 40% of the total cross-sectional area of the filament and the exposed end or ends of said layer or layers occupying from 1 to 30% of the total surface area of the filament.

2. A filament as claimed in claim 1, wherein said fiber forming thermoplastic polymer is selected from the group consisting of polyamides, polyesters, polyolefins, vinyl polymers, polyethers and polycarbonates.

3. A filament as claimed in claim 1, wherein said fiber-forming polymer is at least one polymer selected from the group consisting of polyamides, polyesters, polyolefins and vinyl polymers.

4. A filament as claimed in claim 2 or claim 3, wherein said polyamide is at least one polymer selected from the group consisting of nylon-6, nylon-66, nylon-11, nylon-12, nylon-610, nylon-612 and copolymers thereof.

5. A filament as claimed in claim 2 or claim 3, wherein said polyester is at least one polymer selected from the group consisting of polyethylene terephthalate, polybutylene terephthalate, polyethylene oxybenzoate and copolymers thereof.

6. A filament as claimed in claim 2 or claim 3, wherein said polyolefin is at least one polymer selected from the group consisting of crystalline polyethylene, polypropylene and copolymers thereof.

7. A filament as claimed in claim 2 wherein said polyether is at least one polymer selected from the group consisting of crystalline polymethylene oxide, polyethylene oxide, polybutylene oxide and copolymers thereof.

8. A filament as claimed in claim 1, wherein said polymers having a crystallinity of not less than 60% are selected from the group consisting of highly crystalline polyolefins, polyethers, linear polyesters, polycarbonates, cellulosic polymers and vinyl alcohol polymers.

9. A filament as claimed in claim 1, wherein said conductive metal oxide is at least one material selected from the group consisting of zinc oxide, tin oxide, indium oxide and zirconium oxide.

10. A filament as claimed in claim 1, wherein said conductive metal oxide particles comprise a core made of at least one of a metal oxide and a non-metal oxide, the surface of said core being coated with an electrically conductive metal oxide.

11. A filament as claimed in claim 10, wherein said core is made of at least one material selected from the group consisting of titanium oxide, zinc oxide, iron oxide, aluminum oxide, magnesium oxide and silicon oxide.

12. A filament as claimed in claim 10, wherein said electrically conductive metal oxide coating is made of at least one material selected from the group consisting of zinc oxide, tin oxide, indium oxide, zirconium oxide and copper oxide.

13. A filament as claimed in claim 1, wherein the average grain size of said electrically conductive metal oxide particles is not more than 0.5 μm.

14. A filament as claimed in claim 1, wherein the specific resistance of said electrically conductive metal oxide particles is not more than $10^2$ Ω·cm.

15. A filament as claimed in claim 1, wherein the light reflectivity of said electrically conductive metal oxide particles is not less than 40%.

16. A filament as claimed in claim 1, wherein said electrically conductive metal oxide particles comprise 30–85% by weight of the total weight of said electrically conductive component.

17. A filament as claimed in claim 1, wherein the specific resistance of said electrically conductive component is not more than about $10^7$ Ω·cm.

18. A filament as claimed in claim 1, wherein the conjugate ratio of the electrically conductive component to the electrically non-conductive component is in the range of 3/97 to 60/40.

19. A filament as claimed in claim 1, wherein each said layer is of uniform thickness throughout substantially all of its length so as to prevent separation of said electrically conductive component from said electrically non-conductive component.

20. A filament as claimed in claim 1, wherein each said layer is of increased thickness at a location spaced inwardly from said one end thereof toward the interior of the filament so as to prevent separation of said electrically conductive component from said electrically non-conductive component.

21. A filament as claimed in claim 1 in which said electrically conductive component consists of a single planar layer which extends partway across the filament a distance of from 1/5 to 4/5 the width of the filament.

22. A filament as claimed in claim 1 in which said electrically conductive component consists of a single layer which is zigzag in transverse cross-section and which extends partway across the filament a distance of from 1/5 to 4/5 the width of the filament.

23. A filament as claimed in claim 1 in which said electrically conductive component consists of a single Y-shaped layer wherein the stem extends to the external surface of the filament and the diverging branches are embedded within the filament, said layer extending partway across the filament a distance of from 1/5 to 4/5 the width of the filament.

24. A filament as claimed in claim 1 in which said electrically conductive component consists of a single layer having a planar portion extending to the external surface of the filament and having an enlarged portion at its inner end, said layer extending partway across the filament a distance of from 1/5 to 4/5 the width of the filament.

25. A filament as claimed in claim 1 in which said electrically conductive component consists of a single layer having a portion of reduced thickness between the inner and outer ends thereof, said layer extending partway across the filament a distance of from 1/5 to 4/5 the width of the filament.

26. A filament as claimed in claim 1 in which said electrically conductive component consists of a single planar layer which extends across the entire width of the filament so that the opposite ends of the layer are exposed on the outer surface of the filament.

27. A filament as claimed in claim 1 in which said electrically conductive component consists of a plurality of layers whose inner ends are integral with each other at a common center located in the central interior portion of the filament and which extend to spaced-apart locations on the periphery of the filament.

28. A filament as claimed in claim 1 in which said electrically conductive component consists of a plurality of parallel, planar layers which extend across the filament so that the opposite ends of the layers are exposed on the outer surface of the filament.

29. A filament as claimed in claim 21, claim 22, claim 23, claim 24 or claim 25 in which said layer or layers occupy from 3 to 10% of the total cross-sectional area of the filament and the exposed end or ends of said layer or layers is from 1 to 7% of the total surface area of the filament.

30. A filament as claimed in claim 29 in which the crystallinity of the polymer in said electrically conductive component is from 60 to 80%.

31. A filament as claimed in claim 1 in which the melting point of the polymer in said electrically conductive component is at least 30° C. lower than the melting point of the polymer in said electrically non-conductive component.

* * * * *